United States Patent [19]

Mathew et al.

[11] Patent Number: 4,496,915

[45] Date of Patent: Jan. 29, 1985

[54] MICROWAVE TRANSMISSION DEVICE HAVING GYROMAGNETIC MATERIALS HAVING DIFFERENT SATURATION MAGNETIZATIONS

[75] Inventors: Moni G. Mathew; Thomas J. Weisz, both of Sunnyvale, Calif.

[73] Assignee: TRW Inc., Redondo Beach, Calif.

[21] Appl. No.: 566,861

[22] Filed: Dec. 29, 1983

Related U.S. Application Data

[63] Continuation of Ser. No. 320,740, Nov. 12, 1981, abandoned, and a continuation of Ser. No. 139,816, Apr. 14, 1980, abandoned.

[51] Int. Cl.[3] ..... H01P 1/387

[52] U.S. Cl. ..... 333/1.1; 333/24.1

[58] Field of Search ..... 333/1.1, 24.1, 24.2, 333/158, 161

[56] References Cited

U.S. PATENT DOCUMENTS

| | | | |
|---|---|---|---|
| 3,128,439 | 4/1964 | Brown, Jr. et al. | 333/24.2 |
| 3,295,074 | 12/1966 | Carr | 333/1.1 |
| 3,359,510 | 12/1967 | Geiszler | 333/1.1 |
| 4,122,418 | 10/1978 | Nagao | 333/1.1 X |
| 4,186,357 | 1/1980 | Forterre et al. | 333/24.1 |

*Primary Examiner*—Paul Gensler

*Attorney, Agent, or Firm*—David E. Lovejoy; Robert M. Wallace

[57] ABSTRACT

A multi-port microwave device, such as an isolator or circulator, for transmission of electromagnetic energy in TEM mode non-reciprocally between ports. The device exhibits low insertion loss, high return loss (low VSWR) and high isolation and is operable over a 100 percent or more bandwidth. The microwave device includes a composite ferrite body between a circuit conductor and a ground plane. The composite ferrite body includes at least two different types of ferrite material where each one is selected to provide different frequency characteristics over the frequency pass band of the device.

21 Claims, 5 Drawing Figures

MICROWAVE TRANSMISSION DEVICE HAVING GYROMAGNETIC MATERIALS HAVING DIFFERENT SATURATION MAGNETIZATIONS

This is a continuation of applications Ser. No. 139,816, filed Apr. 14, 1980, and Ser. No. 320,740, filed Nov. 12, 1981 both now abandoned.

CROSS REFERENCE TO RELATED APPLICATIONS

Cross reference is made to application Ser. No. 292,202, filed Aug. 12, 1981, now U.S. Pat. No. 4,390,853, which is a continuation of application Ser. No. 139,815, filed Apr. 14, 1980, abandoned, by Moni G. Mathew and Thomas J. Weisz.

BACKGROUND OF THE INVENTION

The present invention relates generally to microwave devices and more particularly to non-reciprocal microwave devices, such as circulators and isolators, having a large bandwidth.

Circulators and isolators are special classes of microwave devices which, like other transmission line devices, function to transfer or guide energy from one point to another. Such devices are normally classified on the basis of the field configurations called "modes" which they transmit. Devices are generally divided into groups, those capable of transmitting transverse electromagnetic (TEM) modes and those able to transmit higher-order modes. In a TEM mode, the electric field (E) and the magnetic field (H) are entirely transverse to the direction of propagation with no component of either E or H in the direction of transmission. The higher-order modes have components of E or H in the direction of transmission. The circulators and isolators of the present invention are particularly for TEM mode transmission.

Circulators and isolators are well-known microwave devices for transferring energy between two or more ports. At least one input port receives electromagnetic energy and efficiently transfers that energy to an output port. Electromagnetic energy, if any, appearing as an input at the output port is not efficiently transferred, however, to the input port. Hence, the connection of electromagnetic energy among the various input and output ports of circulators and isolators is said to be non-reciprocal and the devices function to isolate input ports from output ports.

In a circulator, the direction of the magnetic field controls the direction of circulation of electromagnetic energy. For example, in a 3-port circulator, when the magnetic field is in a first direction normal to the plane of propagation, circulation among the ports numbered one, two and three is clockwise from one to two, from two to three, and from three to one and when the magnetic field is in the opposite direction, the circulation is from one to three, from three to two and from two to one.

When one of the ports of a 3-port circulator is terminated with the characteristic impedance of the device, the device functions as an isolator. With such a termination, the performance between the remaining two non-terminated ports is the same as for a 3-port circulator.

The performance of isolators and circulators is measured in terms of the insertion loss which is a measure of the efficiency of transmission from the input port to the output port. Another measure of performance is the return loss (or VSWR) which is a measure of how well the circulator is matched to the characteristic impedance. Also, the performance is measured in terms of the isolation of the input port from the output port. Another measure of the performance is the operating bandwidth over which the device may be employed for effective transfer of energy.

Good performance is achieved when the device has a low insertion loss, high return loss (low VSWR) and high isolation over a broad band of frequencies.

Since circulators and isolators and other microwave devices frequently find applications in airborne and satellite vehicles, small size and light weight are important objectives for these devices.

The basic structure and the theory of operation of circulators and isolators has been described in the literature for many years. For example, one well-known article is "Operation of the Ferrite Junction Circulator" by Fay and Comstock, *IEEE Transaction on Microwave Theory and Technique,* January, 1965, pages 15 through 27. In that article, a basic 3-port strip-line circulator is described. Such 3-port circulators are sometimes called Y-junction strip-line circulators. Other multi-port circulators are also described.

It is well known from that article and otherwise that strip-line circulators basically include a center conductor located equidistant between a first ground plane on one side and a second parallel ground plane on the other side. A layer of material, such as ferrite, exhibiting gyromagnetic properties, is located between the center conductor and one ground plane and similarly a second layer of the same ferrite material is located between the center conductor and the other ground plane. In a 3-port circulator, the center conductor is normally configured in the shape of a Y with three legs, each positioned in a flat plane projecting outwardly from a center point at angles of 120 degrees. The ferrite layers lie in a plane parallel to the plane formed by the center conductor and the two ground planes. A magnetic field is applied perpendicular to these planes through the ferrite layers and the center conductor. The magnetic field functions to bias the ferrites near but not at their saturization magnetization. These devices are known as below resonance devices.

In circulators of this well known type, the bandwidth tends to be limited due to high insertion losses at the low frequency end of the pass band and tends to be limited due to higher-order moding (non TEM transmission) at the high frequency end of the pass band. Operation of such circulators is in a single perfect circulation mode.

The bandwidth is defined to be the difference between the highest frequency of operation and the lowest frequency of operation at which acceptable levels of insertion loss without higher-order moding can be achieved. The bandwidth is given as follows:

$$BW = f_h - f_l \qquad \text{Eq.(1)}$$

where:

BW = bandwidth $f_h$ = highest frequency of pass band $f_l$ = lowest frequency of pass band In microwave devices, bandwidth is frequently measured in terms of the percent of the center frequency of the pass band as follows:

$$\%BW = (100)(f_h - f_l)/f_c \qquad \text{Eq.(2)}$$

where:

%BW = percent bandwidth relative to center frequency $f_h$ = high frequency of pass band $f_l$ = low frequency of pass band $f_c$ = center frequency of pass band = $(f_l + f_h)/2$ If the bandwidth is one octave, that is $f_h = 2\ f_l$, then the percent bandwidth is as follows:

$$\%BW = 100(f_l)/(3f_l/2) = 200/3 = 66.66\% \quad \text{Eq.(3)}$$

From Eq.(3), it is clear that a one octave bandwidth is equal to 66.66 percent bandwith. For example, a microwave device which operates over a bandwidth of 2 through 4 GHz ($10^9$ Hz) operates over one octave since the higher frequency is twice the lower frequency. The percent bandwidth is determined by Eq.(3) where the center frequency is 3 and the bandwidth is 2 so that the percent bandwidth is (2/3)(100) or 66.66%. For a device in which the bandwidth extends over two octaves, for example from 2 through 8 GHz, the center frequency is 5, and the bandwidth is 6 and the percent bandwidth is (6/5)(100) or 120 percent.

Strip-line circulators have been available with acceptable insertion loss and isolation over one octave (66 percent bandwidth). There is a need for it and it is an object of the present invention to provide improved devices having low insertion loss and high isolation up to 100 percent bandwith or more and particularly to provide such devices which are compact and light weight.

It is still another object of this invention to provide a 100 percent or more bandwidth circulator and/or isolator that may be easily manufactured.

It is another object of this invention to provide a 100 percent or more bandwidth circulator and/or isolator for microwave transmission which will handle relatively high power of fifty watts or more.

It is an additional object of this invention to provide a device which functions equally well as a circulator or as an isolator.

SUMMARY OF THE INVENTION

The present invention is a multi-port microwave device, such as an isolator or circulator, for transmission of electromagnetic energy in TEM mode nonreciprocally between ports. The device exhibits low insertion loss and high isolation and is operable over a 100 percent or more bandwidth. The microwave device includes a composite ferrite layer or body between a circuit conductor and a ground plane. The composite ferrite body includes at least two different types of ferrite material where each one is selected to provide different frequency characteristics over the frequency pass band of the device.

In one preferred embodiment, a 3-port strip-line circulator is provided. The circulator includes a center conductor located in a plane which lies parallel to and equidistant between two parallel ground planes. Both regions between the center conductor and the ground planes are filled with composite bodies each including a dielectric and two different ferrite materials. The dielectric and ferrite materials are arrayed in concentric cylinders with the outer cylinder being the dielectric material. In the 3-port embodiment, three legs forming the center conductor connect at a center point and extend outwardly from the center point at angles of 120 degrees. The diameter and the relative permittivity of the dielectric material is selected to provide a small microwave device which can be constructed without excessive difficulty. A wide latitude is available in the selection of the permittivity and diameter of the dielectric ring.

The type of and properties of the ferrite materials for the different ferrite cylinders are selected to have different saturation magnetizations, $4\pi M_s$, at different frequencies within the pass band of the device. In a device having a pass band from a low frequency, $f_l$, to a high frequency, $f_h$, the first one of the ferrite materials is selected to have a saturation magnetization determined as a function of a first ferrite frequency, $f_{F1}$, equal or nearly equal to the low frequency, $f_l$, of the pass band.

A second one of the ferrite materials is selected to have a saturation magnetization determined as a function of a second ferrite frequency, $f_{F2}$, where $f_{F2}$ is selected to be below the frequency at which higher-order moding occurs. A third and additional ferrite materials may be selected to have saturation magnetizations as a function of ferrite frequencies, $f_F$, within the pass band of the device and which frequencies are below those at which higher-order moding occurs.

After selecting materials with the desired saturation magnetizations, the relative permittivity of those ferrite materials is known and determines the wavelength of electromagnetic radiation in the materials as a function of frequency. The outer diameters of the ferrite materials are selected to be equal to one-half the wavelength of the electromagnetic waves in the ferrites at each of their respective low ferrite frequencies, $f_F$. Specifically, the diameter $D_{F1}$ of a first ferrite material is selected equal to one-half the wavelength at the low ferrite frequency $f_{F1}$ where $f_{F1}$ is typically equal to the low pass band frequency $f_l$. The diameter $D_{F2}$ of a second ferrite material is selected equal to one-half the wavelength at the low ferrite frequency $f_{F2}$ for the second ferrite material. The frequency $f_{F2}$ is selected to be lower than the frequency at which higher-order moding occurs. If additional ferrites are employed, their diameters similarly are selected to one-half the wavelength at the higher frequencies for the different ferrite materials.

The ground plane spacing, S, is selected to prevent higher-order moding up to some frequency such as the highest frequency, $f_h$, of the pass band of the device.

The ground plane spacing thus determined is equal to the sum of the thickness, h, of each of the two composite ferrite and dielectric bodies and the thickness, t, of the inner conductor. The thickness of the inner conductor is selected to be a convenient dimension so that the thickness of the composite ferrite and dielectric layers is also established.

With the above dimensions of the device established, the structure of the center conductor is selected with steps determined for impedance matching thereby minimizing insertion loss and thereby achieving an acceptable voltage standing wave ratio (VSWR).

In accordance with the above summary, the present invention achieves the objective of providing improved microwave devices, such as 3-port circulators and isolators, which exhibit low insertion loss and high isolation, which can be 100 percent bandwidth or more and which can be compact and lightweight.

Additional objects and features aof the present invention will appear from the following description in which the preferred embodiments of the invention have been set forth in detail in conjunction with the drawings.

DETAILED DESCRIPTION

Figure 1:
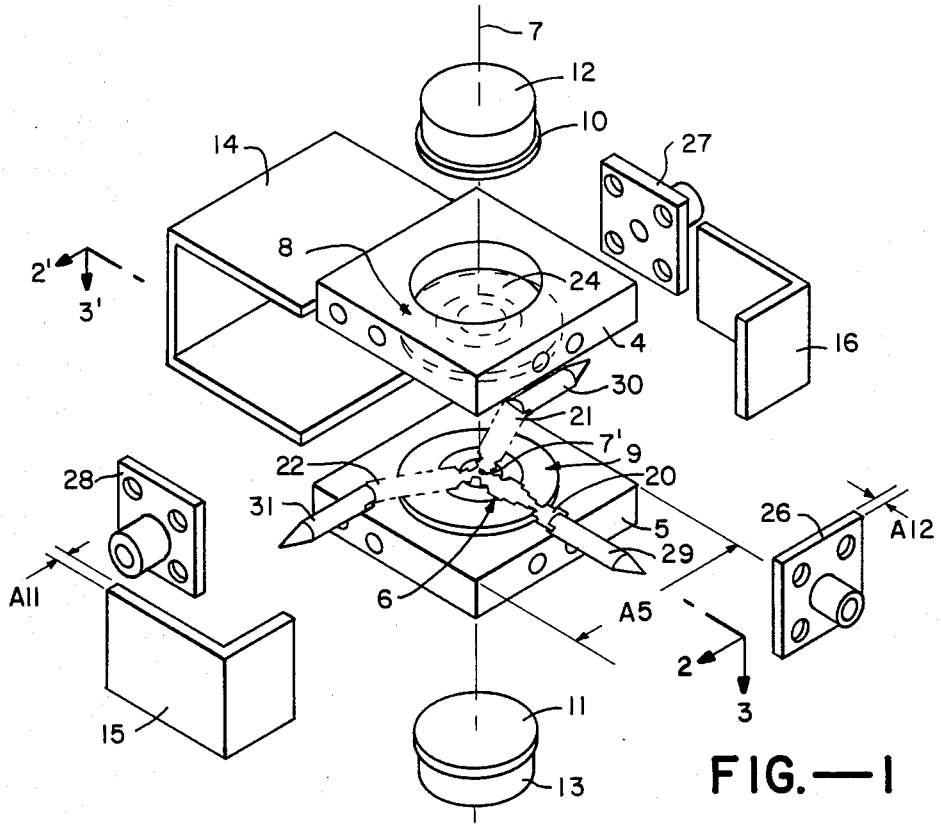
FIG. 1 is an exploded assembly view of a 3-port circulator employing a layer having two or more ferrite materials for achieving broad-bandwidth operation in accordance with the present invention.

In FIG. 1, a typical non-reciprocal microwave device in accordane with the present invention is depicted in the form of a 3-port strip-line circulator. The circulator includes a first ground plane conductor 4 and a second ground plane conductor 5 which are both typically made from non-magnetic materials such as aluminum. The ground plane conductor 4 has an opening 24 for receiving a magnetic shunt 10, made from a magnetic material such as cold-rolld steel, and a magnet 12. The ground plane conductor 5 is a mirror image of top ground plane conductor 4 and similarly has an opening 25 (see FIG. 2) for receiving a shunt 11 and a magnet 13. The shunts 10 and 11 and the magnets 12 and 13 establish a magnetic field in the region between the ground plane conductors 4 and 5 through the composite ferrite and dielectric bodies which form the layers 8 and 9 and which are located on either side of the center conductor 6. The center conductor 6 includes three legs 20, 21 and 22 which connect at a common point 7′ on the center axis 7. Each of the legs extends outwardly at angles of 120 degrees from each other in a center plane parallel to the ground planes formed by the ground plane conductors 4 and 5.

Each of the legs 20, 21 and 22 connects to one of the pins 29, 30 and 31, respectively, which constitute the center conductors of the three coaxial ports of the microwave device. The connectors 26, 27 and 28 form the outer conductors of the three coaxial ports. Each of the three connectors 26, 27 and 28 connects to the ground plane conductors 4 and 5. The pins 29, 30 and 31 protrude into the center of connectors 26, 27 and 28 without physical contact thereto. The pin 29, 30 and 31 and the connectors 26, 27 and 28 are all typically made of brass or berrillium copper.

When the microwave device of FIG. 1 is assembled, the end plates 15 and 16 abut the sides of the ground plane conductors 4 and 5 on the sides at which the pins 31 and 30 extend, respectively. The end plates 15 and 16 are typically made of non-magnetic materials such as aluminum. The top and bottom ground plane conductors 4 and 5 fit within the wraparound shield 14. The shield 14 is typically made of a magnetic material such as cold-rolled steel which forms a magnetic field path for the field established by the magnets 12 and 13. The magnetic field path is completed through the center conductor 6 and dielectric and ferrite layers 8 and 9 in a direction parallel to the vertical axis 7.

Figure 2:
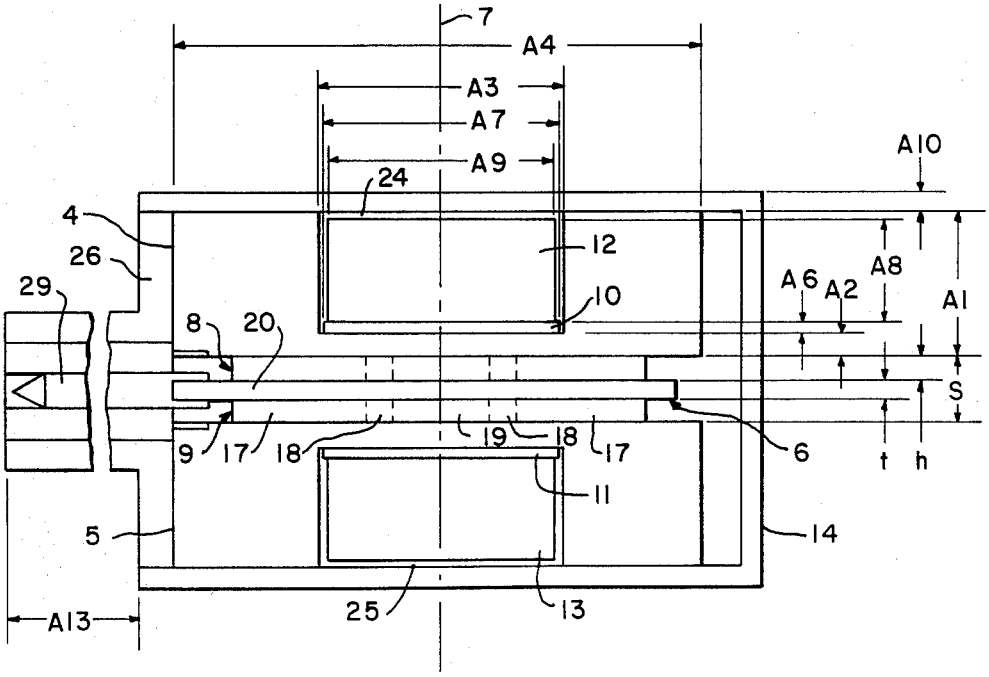
FIG. 2 is a sectional view of the device of FIG. 1 along the section line 2—2′ of FIG. 1 and assembled to be non-exploded.

In FIG. 2, a section view along the section line 2—2′ of FIG. 1 is shown as if FIG. 1 was not exploded. In FIG. 2, the ground plane conductors 4 and 5 are contained within the wraparound shield 14. The shunts 10 and 11 and magnets 12 and 13 are located within the openings 24 and 25 in the ground plane conductors 4 and 5. In this manner, a magnetic field with an axis parallel to the center axis 7 is established in a region between the ground plane conductors 4 and 5.

The separation distance, S, between the two ground plane conductors 4 and 5 is filled with the composite dielectric and ferrite body comprising layer 8, the center conductor 6, and the composite dielectric and ferrite body comprising layer 9. The thickness, h, of each of the layers 8 and 9 is the same. The center conductor 6 having a thickness, t, together with the cylinders 8 and 9 fill the gap between the ground plane conductors 4 and 5.

Figure 3:
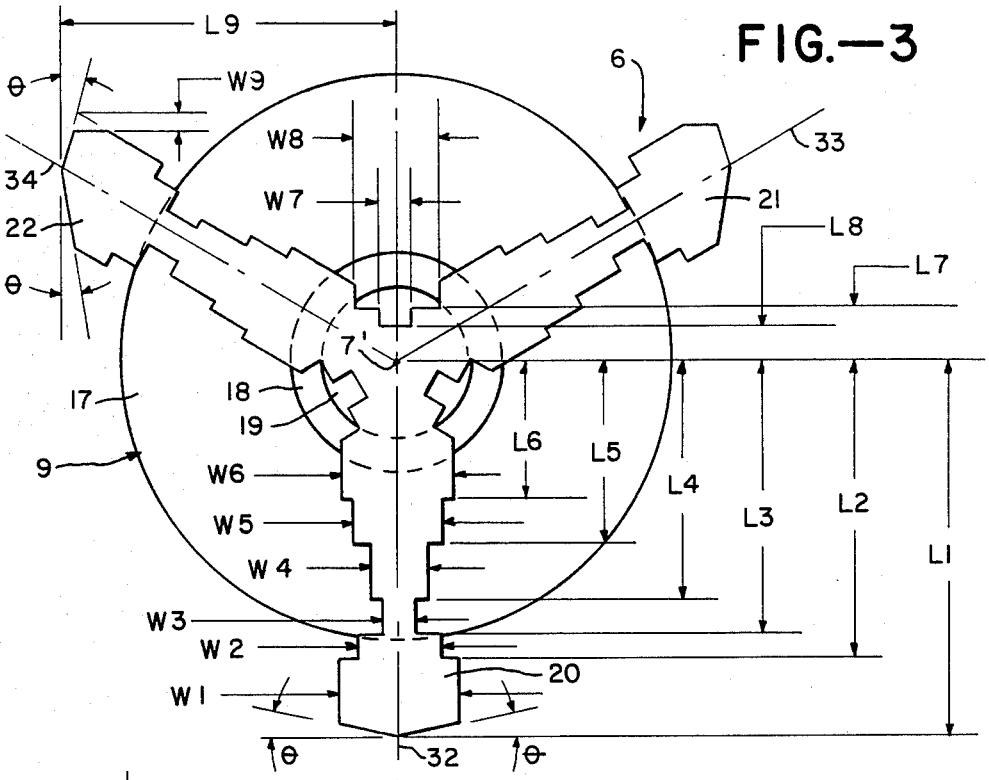
FIG. 3 is a sectional view of the device of FIG. 1 along the section line 3—3′ of FIG. 1 and assembled to be non exploded.

In FIG. 3, a section view of the center conductor 6 and the composite dielectric and ferrite layer 9 is shown taken along the section line 3—3′in FIG. 2. The ground plane conductor 5, the shunt 11 and the magnet 13 are not shown in FIG. 3 for clarity.

In FIG. 3, the center conductor 6 includes the legs 20, 21 and 22 arrayed symmetrically with respect to the axis point 7′ for the axis 7 which runs normal to the plane of the paper. The lengths of the legs measured along the outwardly extending axes 33 and 34 are both the same and are equal to 0.522 inch (1.326 cm.). The leg 32 is 0.452 inch (1.148 cm.). That length is designated in FIG. 3 as L1. Each of the legs varies in width symmetrically about its respective center axis with changes in width indicated at various points measured from the center point 7′. In FIG. 3 various lengths from the center point 7′ are indicated as L1, L2, . . . , L9. Similarly, different widths are designated in FIG. 3 by W1, W2, . . . , W9. Additionally, the ends of the conductors 20, 21 and 22 are tapered by an angle theta which is measured for leg 20 with respect to a line perpendicular to the axis 32 and measured for the legs 21 and 22 with respect to lines parallel to the axis 32.

In FIG. 3, the dielectric and ferrite materials forming the layer 9 are arrayed concentrically around the center point 7′ of the center conductor 6. The dielectric cylinder 17 has a diameter $D_D$ and a radius $R_D$ which extends approximately to the length L3 from the center point 7′. The first ferrite cylinder 18 is located concentrically within the dielectric cylinder 17 and is in contact therewith around its perimeter. The cylinder 18 has a diameter of $D_{F1}$ and a radius $R_{F1}$ which extends across the legs 20, 21 and 22 in a region designated by the width W6 at a location which is somewhat less than the length L6. Similarly, the second ferrite 19 is located concentrically within the first ferrite 18 and has a center point 7′. The perimeter of ferrite cylinder 19 is in contact with the ferrite 18. The ferrite cylinder 19 has a diameter $D_{F2}$ and a radius $R_{F2}$.

Figure 4:
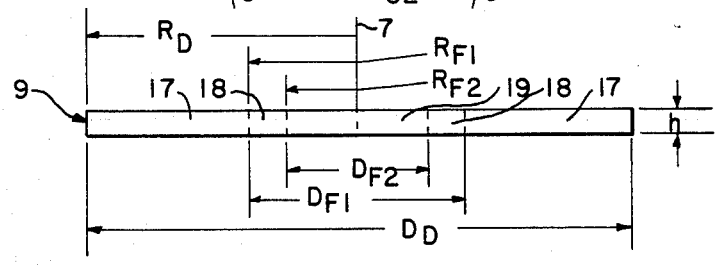
FIG. 4 is an end view of the composite body of FIG. 3.

In FIG. 4, an end view of the composite body 9 is shown. The composite body has a thickness, h, with the dielectric cylinder 17, the first ferrite cylinder 18 and the second ferrite cylinder 19 symmetrically disposed about the center axis 7.

Determination of Dimensions for Device Structure

In order to provide for a microwave device which is generally small and lightweight while still large enough to enable the mechanical dimensions to be easily obtainable, the diameter, $D_D$, of the dielectric cylinder 17 is suitably selected. As a general guideline, it is desirable that a number of impedance matching steps (changes in width) be made in each of the legs 20, 21 and 22 of the center conductor 6. Nominally, these impedance matching steps, if made for a narrow-band device, would be located at quarter wavelength increments along the axes 32, 33 and 34. Since several steps are generally required, the dielectric material is selected to have a radius large enough to permit such steps to be made. The radius $R_D$ of the dielectric cylinder 17 is selected to be several times, generally two or more times, the quarter wavelength determined, for example, at the center frequency of the pass band of the device. The wavelength in the dielectric material is given as follows:

$$\lambda_D = C/[f_c(\epsilon_r)^{\frac{1}{2}}] \qquad \text{Eq.(4)}$$

where:

$\lambda_D$ = wavelength of signal in dielectric material
C = velocity of light in free space
$f_c$ = center frequency = $(f_l + f_h)/2$
$\epsilon_r$ = relative permittivity of dielectric material In Eq.(4), a dielectric material with an $\epsilon_r$ of 6 is selected. For a device with a pass band from $f_l$ equal to 6 GHz to $f_h$ equal to 18 GHz, the center frequency $f_c$ is 12 GHz. Evaluating Eq.(4) using the above values determines the wavelength as approximately 0.4 inch (1.02 cm.). Accordingly, a quarter wavelength calculated in accordance with Eq.(4) is approximately 0.1 inch (0.254 cm.). In one particular embodiment, the radius, $R_D$, of the dielectric cylinder 17 is selected as 0.340 inch (0.864 cm.) which is more than three times the quarter wavelength of the center frequency.

Having thus specified the radius and relative permittivity of the dielectric material, the saturation magnetizations of the first and second ferrite materials are selected. The saturation magnetization is selected in accordance with the following equation:

$$4\pi M_s = (f_{Fi})(p)/(2.8 \times 10^6) \qquad \text{Eq.(5)}$$

where:

$4\pi M_{si}$ = saturation magnetization for the "$i^{th}$" ferrite
p = proportionally factor
$f_{Fi}$ = low ferrite frequency for the "$i^{th}$" ferrite In Eq.(5), the proportionality factor, p, is selected as less than unity so that operation occurs at less than saturation. In one particular example p is selected equal to 0.817. The proportionality factor, p, in Eq.(5) is essentially the same as the p factor described in the above-reference article "Operation of the Ferrite Junction Circulator" by Fay and Comstock at the point preceeding Eq.(35) therein.

In Eq.(5), for the particular example having a pass band from 6 GHz through 18 GHz, the low ferrite frequency $f_{Fi}$, for the first ferrite for "i" equal to 1 is denoted as $f_{F1}$ and is initially selected equal to 6 GHz. Using the above values for p and $f_{Fi}$ in Eq.(5) provides the saturation magnetization for the first ferrite as equal to 1750 gauss. Having thus determined the desired saturation magnetization, a ferrite material with such saturation magnetization is obtained readily or is selected from those purchasable. For example, in one particular embodiment, a yttriun garnet ferrite marketed by TRANS-TECH, type number G-113 is selected with a saturation magnetization of 1780 gauss which is close to the calculated value of 1750 gauss. The 1780 gauss value when utilized in Eq.(5) establishes the low ferrite frequency $f_{F1}$ as 6.1 GHz rather than the previously selected 6.0 GHz. The dielectric constant $\epsilon_r$ for that ferrite is 15.

Strip-line circulators using a single ferrite structure are generally capable of a one octave frequency operating range without having higher-order moding. The ferrite materials are particularly useful for controlling TM higher-order moding due to the gyromagnetic properties of ferrites. Using this general guide, the first ferrite material 18 is likely to provide acceptable operation over the frequency range from 6 GHz to 12 GHz. In accordance with one embodiment of the present invention, the saturization magnetization of a second ferrite material 19 is selected employing Eq.(5) where for "i" equal to 2 the low ferrite frequency $f_{F2}$ is somewhat less than the one octave frequency of 12 GHz. The second low ferrite frequency $f_{F2}$ is typically selected at a frequency which is 85% to 90% of the one octave frequency. In one particular example, 86% of the 12 GHz frequency is selected and is equal to 10.32 GHz. Employing 10.32 GHz as the low ferrite frequency $f_{F2}$ in Eq.(5) produces a saturation magnetization of 3000 gauss. In one particular embodiment, a nickel ferrite is available from TRANS-TECH, type number TT2-101 having a saturation magnetization of 3000 gauss and a dielectric constant $\epsilon_r$ of 12.8.

In the preferred embodiments, the inner ferrite cylinder 19 (effective for the higher frequencies) has a higher saturation magnetization than the outer ferrite cylinder 18 (effective for the lower frequencies).

Having thus selected the appropriate ferrite materials for the first and second ferrites 18 and 19, the diameter $D_{Fi}$ of each ferrite cylinder to be employed is now determined for "i" equal to 1 and 2 in accordance with the following equation:

$$D_{Fi} = C/[(2)(f_{Fi})(\epsilon_{ri})^{\frac{1}{2}}] \qquad \text{Eq.(6)}$$

where:

$D_{Fi}$ = diameter of "$i^{th}$" ferrite cylinder
C = velocity of light in space
$f_{Fi}$ = low ferrite frequency for "$i^{th}$" ferrite
$\epsilon_{ri}$ = relative permittivity of "$i^{th}$" ferrite Eq.(6) is evaluated with "i" equal to 1 to determine a diameter, $D_{F1}$, for the first ferrite 18 using the relative permittivity $\epsilon_{ri}$ of 15 and a low ferrite frequency $f_{F1}$ equal to 6.1 GHz. Using these values, $D_{F1}$ is equal to 0.250 inch (0.635 cm.) and the radius $R_{F1}$ is equal to 0.125 inch (0.317 cm.).

In a similar manner, Eq.(6) is evaluated for "i" equal to 2 to determine the diameter, $D_{F2}$, of the second ferrite using $f_{F2}$ as equal to 10.32 GHz and using the relative permittivity $\epsilon_{r2}$ equal to 12.8. Using these values in Eq.(6) determines $D_{F2}$ equal to 0.160 inch (0.406 cm.) and the radius $R_{F2}$ equal to 0.080 inch (0.203 cm.).

Having thus determined the outer diameters of the first and second ferrites, the thickness of the composite dielectric and ferrite bodies 8 and 9 is now determined. The thickness is determined by first determining the ground plane spacing, S, in accordance with the following equation:

$$S = (\lambda_h)/[(3)(\epsilon_r)^{\frac{1}{2}}] \qquad \text{Eq.(7)}$$

where:

S = ground plane spacing
$\lambda_h$ = wavelength ($\lambda_h = C/f_h$)
$\epsilon_r$ = relative permittivity of dielectric material C = velocity of light in space $f_h$ = high frequency of pass band The purpose of selecting a particular ground plane spacing is to inhibit higher-order moding up to at least the highest frequency, $f_h$, of the pass band of the microwave device. Ground plane spacing is particularly effective for inhibiting higher-order moding TE type electromagnetic energy. In the present example, $f_h$ is desired to be 18 GHz.

The above Eq.(7) differs from other proposed equations for microwave devices. For example, the article "How Much CW Power Can Strip-Lines Handle?" published by Paul Schiffres, *Microwave,* June, 1966, proposed in his equation 1 the use of a constant 2 rather than a constant 3 employed in Eq.(7) above. However, it has been found that the above Eq.(7) is much preferrable.

Evaluating Eq.(7) using the relative permittivity of the dielectric material as equal to 6 and using the high frequency of the pass band as equal to 18.68 GHz, provides the ground plane spacing, S, as 0.086 inch (0.219 cm.). The reason that 18.68 GHz is employed rather than 18 GHz is to provide a guardband which serves as a safety factor to insure that no moding occurs in the desired pass band. After determination of the ground plane spacing, the inner conductor is selected with an arbitrary thickness of 0.016 inch (0.041 cm.) because brass stock of that thickness is readily available. Thereafter the thickness of each of the composite ferrite and dielectric layers is calculated using the following equation:

$$S = 2h + t \qquad \text{Eq.(8)}$$

where:

S = ground plane spacing h = ferrite and dielectric composite body thickness t = inner conductor thickness Evaluating Eq.(8) using t as 0.016 inch (0.041 cm.) provides the ferrite and dielectric layer thickness, h, as equal to 0.035 inch (0.089 cm.).

Having selected the dimension and characteristics of the dielectric and ferrite layer, the inner conductor 6 is now tailored for impedance matching.

In accordance with the above Eq.(4) the quarter wavelength steps are approximately 0.1 inch (0.254 cm.) for a narrow-band device at the 12 GHz frequency. The rules applicable to narrow-band devices, however, are not directly applicable to the broad-band devices of the present invention. While a mathematical analysis of steps for impedance matching in a broad-band device can be undertaken, such analysis is complicated so that experimental techniques are usually preferred. In general, the determination of characteristic impedance and impedance matching in dielectric regions is well known from the published literature. Also, as a general guide, the impedance in the ferrite region is given by the following equation:

$$Z_F = (h\alpha Q_L)/[(0.74)\omega R^2 \epsilon_o \epsilon_r] \qquad \text{Eq.(9)}$$

where:

$Z_F$ = impedance in ferrite region h = ferrite thickness $\alpha$ = center conductor function $Q_L$ = loaded Q [proportional to saturation magnetization ($4\pi Ms$)]

$\omega = 2\pi f$ where f is frequency $R_F$ = outer radius of ferrite $\epsilon_o$ = permittivity in space $\epsilon_r$ = relative permittivity of ferrite From Eq.(9) it is apparent that as the radius of the ferrite decreases, the impedance increases. In order to compensate for a smaller radius, the relative permittivity of the ferrite may be increased, the thickness of the ferrite may be decreased or the loaded Q may be increased by increasing the saturation magnetization. Such variations, of course, involve design choices which affect many of the calculations in the above Eqs.(1)through (9).

As a general guide, characteristic impedance matching is carried out by having a plurality of impedance matching steps in the elongated members 20, 21 and 22 which are the legs of the center conductor 6. Some of the different steps in each of the elongated members are equal to respectively different quarter wavelengths or less of different frequencies within the pass band of the device. Less than quarter wavelength dimensions are particularly useful for fringe effects.

In order to minimize the mismatch of the characteristic impedance, matching is carried out using the experimentally derived center conductor design having a plurality of impedance matching steps as shown in FIG. 3 where the L1, L2, . . . , L9 and the W1, W2, . . . , W9 dimensions are given by the following TABLE I:

TABLE I

| LENGTH (inches) | | WIDTH (inches) | | IMPEDENCE (ohms) |
|---|---|---|---|---|
| L1 | 0.452 | W1 | 0.118 | 50 |
| L2 | 0.380 | W2 | 0.064 | 45 |
| L3 | 0.338 | W3 | 0.032 | 40 |
| L4 | 0.286 | W4 | 0.046 | 35 |
| L5 | 0.220 | W5 | 0.057 | 25 |
| L6 | 0.160 | W6 | 0.073 | 16 |
| L7 | 0.059 | W7 | 0.090 | 8–12 |
| L8 | 0.050 | W8 | 0.176 | 8–12 |
| L9 | 0.435 | W9 | 0.050 | — |

The estimated characteristic impedance at the different points along the axis of the center conductor for the widths W1 through W6 are shown in the right-hand column. The characteristic impedance in the ferrite regions generally ranges between 8 and 12 ohms.

The magnets 12 and 13 are each selected to have a magnetic field H such that the local magnetic field in the ferrite is below the lowest saturation magnetization of any of the ferrite materials of the device (that is, below 1750 gauss in the particular embodiments described). For example, in the embodiments described, magnets 12 and 13 each have H equal to 1300 gauss (for a total field of 2600 gauss). The total field of 2600 gauss is reduced, of course, in the structure, which includes the ground plane spacing and the shunts, to a local field in the ferrites of less than 1750 gauss.

By way of summary, a first example of a 3-port stripline circulator having a pass band from approximately 6 to 18 GHz is provided with materials having the properties and dimensions as set forth in TABLE I above and in the following TABLE II below:

TABLE II

| | | |
|---|---|---|
| Dielectric | $D_D$ = | 0.680 inch (0.727 cm.) |
| | $\epsilon_r$ = | 6 |
| First Ferrite (outer) | $4\pi M_{s1}$ = | 1750 gauss |
| | $\epsilon_{r1}$ = | 15 |
| | $D_{F1}$ = | 0.250 inch (0.635 cm.) |
| | F1 = | 6.1 GHz |
| Second Ferrite (inner) | $4\pi M_{S2}$ = | 3000 gauss |

TABLE II-continued

| | | |
|---|---|---|
| | $\epsilon_{r2}$ = | 12.8 |
| | $D_{F2}$ = | 0.160 inch (0.406 cm.) |
| | F2 = | 10.32 GHz |
| Each Magnet | H = | 1300 gauss |
| (Samarium cobalt) | | |
| S = 0.086 inch (0.2184 cm.) | | |
| t = 0.016 inch (0.0406 cm.) | | |
| h = 0.035 inch (0.089 cm.) | | |
| $\theta$ = 15° | | |
| BW = 6–18 GHz | | |
| % BW = 100 | | |
| insertion loss = less than 0.8 dB | | |
| isolation = greater than 14 dB | | |
| VSWR = not greater than 15.1:1 | | |
| Other typical dimensions [inch(cm.)] | | |
| A1 = .235 = .597 | ground plane thickness | |
| A2 = .040 = .102 | ground plane bottom wall thickness | |
| A3 = .405 = 1.031 | ground plane opening diameter | |
| A4 = .875 = 2.222 | ground plane width | |
| A5 = .952 = 2.418 | ground plane length | |
| A6 = .016 = .041 | shunt thickness | |
| A7 = .395 = 1.003 | shunt diameter | |
| A8 = .130 = .330 | magnet thickness | |
| A9 = .375 = .952 | magnet diameter | |
| A10 = .030 = .076 | wraparound shield thickness | |
| A11 = .025 = .068 | side plate thickness | |
| A12 = .065 = .165 | terminal thickness | |

Figure 5:
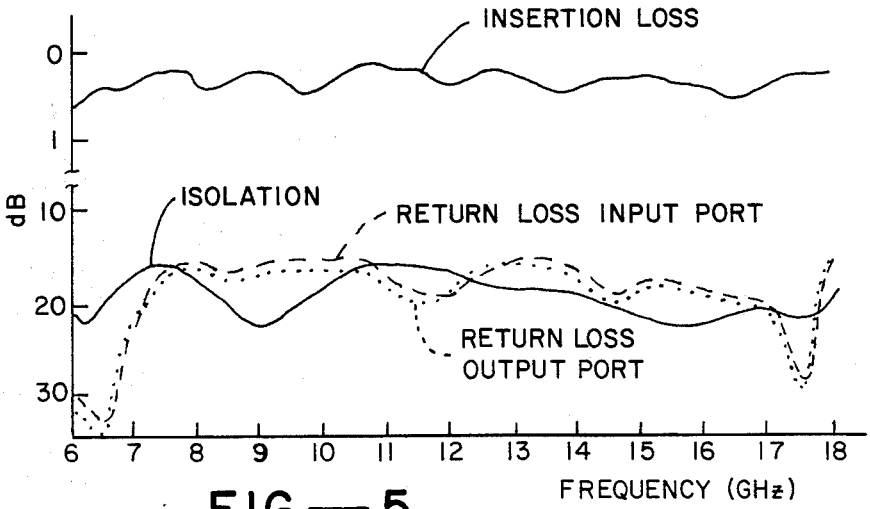
FIG. 5 is a graph showing return loss (VSWR), insertion loss and isolation as a function of the frequency of operation of one device over the pass band from 6 GHz to 18 GHz in accordance with the present invention.

In FIG. 5, the good performance parameters of a device built in accordance with the above rules is shown by voltage standing wave ratio (VSWR), which is indicated in terms of the return loss at the input port and the output port, is shown by the insertion loss, and is shown by the isolation. In FIG. 5, the performance parameters are shown versus frequency over the pass band from 6 GHz to 18 GHz. Over the pass band from 6.0 GHz to 17.0 GHz, a minimum isolation of 14 dB was measured with a maximum insertion loss of 0.8 dB and a maximum VSWR of 1.5:1. These values were measured over a temperature range of −54° C. to +71° C. The performance characteristics were the same over the frequency range from 6.0 through 18.0 GHz with the isolation however a minimum of 13 dB rather than 14 dB over the 17.0 to 18.0 GHz range. The operation is in the single perfect circulation mode.

Second Embodiment

Using the the first example described above as a starting reference, a second example of a 3-port strip-line circulator having a pass band from 8 to 20 GHz is provided with materials having the properties and dimensions as set forth in TABLES III and IV below:

TABLE III

| | LENGTH (inches) | | WIDTH (inches) |
|---|---|---|---|
| L1 | 0.452 | W1 | 0.118 |
| L2 | 0.380 | W2 | 0.064 |
| L3 | 0.338 | W3 | 0.025 |
| L4 | 0.286 | W4 | 0.040 |
| L5 | 0.220 | W5 | 0.057 |
| L6 | 0.160 | W6 | 0.065 |
| L7 | 0.059 | W7 | 0.090 |
| L8 | 0.046 | W8 | 0.176 |
| L9 | 0.435 | W9 | 0.050 |

TABLE IV

| | | |
|---|---|---|
| Dielectric | $D_D$ = | 0.680 inch (1.727 cm.) |
| | $\epsilon_r$ = | 6 |
| First Ferrite (outer) | $4\pi M_{s1}$ = | 1750 gauss |
| | $\epsilon_{r1}$ = | 15 |
| | $D_{F1}$ = | 0.250 inch (0.635 cm.) |

TABLE IV-continued

| | | |
|---|---|---|
| | F1 = | 6.1 GHz |
| Second Ferrite (inner) | $4\pi M_{s2}$ = | 3750 gauss |
| | $\epsilon_{r2}$ = | 15 |
| | $D_{F2}$ = | 0.120 inch (0.3048 cm.) |
| | F2 = | 13.86 GHz |
| Each Magnet | H = | 1300 gauss |
| (Samarium Cobalt) | | |
| S = 0.086 inch (0.218 cm.) | | |
| t = 0.016 inch (0.0416 cm.) | | |
| h = 0.035 inch (0.089 cm.) | | |
| $\theta$ = 15° | | |
| BW = 8–20 GHz | | |
| % BW = 85.7 | | |
| insertion loss = less than 0.8 dB | | |
| isolation = greater than 15 dB | | |
| VSWR = not greater than 1.4:1 | | |

In the example of TABLES III and IV, the dielectric cylinder 17, and the first ferrite cylinder 18 were maintained the same. Similarly, the ground plane spacing was maintained the same. The inner second ferrite cylinder was changed to have a saturation magnetization of 3750 gauss with a relative permittivity of 15. The low ferrite frequency F2 for the inner ferrite was selected to be 13.86 GHz which is approximately 87% of the octave frequency of 16 GHz (2×8 GHz). It should be noted that the outer ferrite 18 was not modified from the previous example where F1 was 6.1 GHz so that the first octave frequency would be 12.2 GHz. The low ferrite frequency F2 is selected as 13.86 GHz notwithstanding the fact that such frequency is greaer than the one octave frequency of 12.2 GHz. The higher frequency of 13.86 GHz is permissible, in part, because the second ferrite material in the second example was selected with a saturation magnetization of 3750 gauss which is higher than the 3000 gauss of the first example. In general, the higher the saturation magnetization, the higher the frequency which can be selected without higher-order moding occurring.

The above second example demonstrates that a wide variation from the design Eqs.(4) through (9) is possible while employing two or more ferrite materials having different properties for achieving broad-band performance in accordance with the present invention.

The device constructed in accordance with TABLES III and IV had a percentage bandwidth of 85.7% when considered over the pass band of 8 through 20 GHz. If the bandwidth of the device is considered over the pass band from 6 through 20 GHz, an insertion loss of less than 1.5 dB is observed. This increased insertion loss in the 6 through 8 GHz range is generally due to a greater mismatch in impedance and in the VSWR. The mismatch can be removed by further altering the dimensions of the inner circuit conductor 6. Such alterations may be determined experimentally. In the second example of TABLE III, only reductions in the dimensions were made relative to the first example of TABLE I. A reduction in the mismatch can be achieved, however, by redesigning the center conductor with variable capacitance values (larger or smaller) achieved by wider or smaller dimensions at certain of the locations W1, W2, . . . , W9. With such a redesign, insertion loss can be reduced extending the pass band to, for example, 6 through 20 GHz.

Further and Other Embodiments

While the previous two examples have described a composite dielectric and ferrite body including two ferrite materials, the present invention encompasses the use of composite bodies including three or more ferrites having properties and dimensions selected in the manner generally outlined above.

While the present invention has been described in detail in connection with a composite dielectric and ferrite body formed of concentric cylinders, other multiple ferrite structures can be employed without departing from the spirit and scope of the invention. In general, for a 3-port strip-line circulator, triangular or other shape materials may be employed. In such a case, the ferrite diameter dimensions may be calculated employing the inscribed cylinder which fits within the shape of the ferrite solid structure employed. If irregular shaped structures are employed, then the calculations become more difficult but can be made directly or can be determined by experimentation without departing from the spirit and scope of the present invention. The present invention contemplates the use of two or more ferrite materials to provide different frequency characteristics over the pass band of a broad-band non-reciprocal microwave device.

While the present invention has been described in terms of strip-line circulators, the principles of the present invention apply to microstrip and other non-reciprocal devices as will be apparent to those skilled in the art.

While the invention has been described in connection with below resonance operation, the invention also may be implemented for above resonance operation. In such a case, the p factor in Eq.(5) is greater than unity. Also, for above resonance operation, the magnets are selected to provide a local magnetic field in the ferrites greater than the highest saturation magnetization for any of the ferrites. Also, the diameters of Eq.(6) are reduced. Frequently, for above resonance devices, triangular-shaped ferrites are employed where the diameter is for the inscribed cylinder with a diameter less than that given by Eq.(6). In the present invention, two or more concentric ferrite triangular-shaped solids or other solid structures are employed where each ferrite has different frequency characteristics.

Although the specific embodiments described in the present application employ permanent magnets, the present invention also embodies electromagnets. Such electromagnets typically may be latched by an appropriate electric current to cause the magnetic field to be in either of two directions. In one direction of the magnetic field, the circulation is clockwise and in the other direction, the circulation is counter-clockwise.

Two or more circulators or isolators in accordance with the present invention are cascaded to increase isolation without reducing the return loss.

While the invention has been particularly shown and described with reference to the preferred embodiments thereof, it will be understood by those skilled in the art that those changes in form and details may be made therein without departing from the spirit and the scope of the invention.

What is claimed is:

1. A microwave transmission device comprising:

a first conductor disposed in a first plane, a second conductor disposed in a second plane in parallel relation and spaced from said first conductor for transmitting TEM electromagnetic energy, a first composite body of gyromagnetic material adapted to be magnetized by a magnetic field and disposed between said first and second conductors, said composite body including first and second gyromagnetic materials having different saturation magnetizations providing broad bandwidth operation for said device, said first and second gyromagnetic materials symmetrically disposed about a center line of said device parallel to the direction of said magnetic field; and said first and second gyromagnetic materials disposed in said device and concentrically formed with first and second diameters establishing first and second ferrite frequencies within the pass band of said device and establishing any subharmonic frequencies outside the pass band of said device thereby to provide operation in a single perfect circulation mode with other perfect circulation modes suppressed.

2. The device of claim 1 including a third conductor disposed in a third plane in parallel relation and spaced from said first and second conductors such that said second conductor is between said first and third conductors and including a second composite body of gyromagnetic material adapted to be magnetized by a magnetic field and disposed between said second and third conductors, said second composite body including first and second gyromagnetic materials having different saturation magnetization providing broad bandwidth operation for said device, said first and second gyromagnetic materials for said second composite body symmetrically disposed about said center line of said device parallel to the direction of said magnetic field; said first and second gyromagnetic materials for each of said composite bodies disposed in said device to provide operation in a single perfect circulation mode with other perfect circulation modes suppressed.

3. A microwave transmission device comprising, a first conductor disposed in a first plane, a second conductor disposed in a second plane in parallel relation and spaced from said first conductor for transmitting TEM electromagnetic energy, a third conductor disposed in a third plane in parallel relation and spaced from said first and second conductors such that said second conductor is between said first and third conductors, a first composite body of gyromagnetic material adapted to be magnetized by a magnetic field and disposed between said first and second conductors, said first composite body including first and second gyromagnetic materials having different saturation magnetizations providing broad bandwidth operation for said device, said first and second gyromagnetic materials symmetrically disposed about a center line of said device parallel to the direction of said magnetic field; and said first and second gyromagnetic materials disposed in said device to provide operation in a single perfect circulation mode with other perfect circulation modes suppressed, a second composite body of gyromagnetic material adapted to be magnetized by a magnetic field and disposed between said second and third conductors, said second composite body including first and second gyromagnetic materials having different saturation magnetization providing broad bandwidth operation for said device, said first and second gyromagnetic materials for said second composite body symmetrically disposed about said center line of said device parallel to the direction of said magnetic field; said first and second gyromagnetic materials for each of said composite bodies disposed in said device to provide operation in a single perfect circulation mode with other perfect circulation modes suppressed, said first and second gyromagnetic materials for each of said first and second composite bodies comprising first and second ferrite cylinders with said second ferrite cylinder concentrically disposed within said first cylinder, said first and second cylinders having first and second outer diameters, respectively, equal to one-half first and second wavelengths, respectively, of electromagnetic energy transmitted at first and second ferrite frequencies, respectively, where said first and second ferrite frequencies are within the frequency pass band of said device and where said second ferrite frequency is less than twice said first ferrite frequency.

4. The device of claim 3 wherein said first and second ferrite cylinders have first and second diameters each determined for "i" equal to 1 and 2, respectively, by:

$$D_{Fi}=C/[(2)(f_{Fi})(\epsilon_{ri})^{\frac{1}{2}}]$$

where:

$D_{Fi}$=diameter of "$i^{th}$" ferrite cylinder

C=speed of light in space $f_{Fi}$="$i^{th}$" ferrite frequency for "$i^{th}$" ferrite cylinder $\epsilon_{ri}$=relative permittivity of "$i^{th}$" ferrite cylinder.

5. The device of claim 3 wherein said first composite body and said second composite body include first and second dielectric cylinders, respectively, where said ferrite cylinders are concentrically disposed within said dielectric cylinders.

6. The device of claim 5 wherein said first and second composite bodies fill the space between said first and second conductors and between said second and third conductors, respectively, and wherein the spacing between said first and third conductors is the ground plane spacing defined by:

$$S=(\lambda_h)/[(3)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

7. A microwave transmission device comprising, first and second ground plane members disposed in spaced parallel relation to each other, conductive planar means disposed between and in parallel relation with and spaced from said ground plane members, said conductive planar means having a central portion and a plurality of elongated members extending therefrom for transmitting TEM-mode energy;

at least two composite bodies of gyromagnetic material adapted to be magnetized by a magnetic field, said bodies symmetrically disposed on opposite sides of at least said central portion of said planar means, each of said two composite bodies including first and second gyromagnetic materials having different saturation magnetizations providing a pass band for broad bandwidth operation of said device; said first and second gyromagnetic materials disposed in said device and concentrically formed with first and second diameters establishing first and second ferrite frequencies within the pass band of said device and establishing any subharmonic frequencies outside the pass band of said device to provide operation in the normal perfect circulation mode with other perfect circulation modes suppressed.

8. A microwave transmission device comprising, first and second ground plane members disposed in spaced parallel relation to each other, conductive planar means disposed between and in parallel relation with and spaced from said ground plane members, said conductive planar means having a central portion and a plurality of elongated members extending therefrom for transmitting TEM-mode energy; at least two composite bodies of gyromagnetic material adapted to be magnetized by a magnetic field, said bodies symmetrically disposed on opposite sides of at least said central portion of said planar means, each of said two composite bodies including first and second gyromagnetic materials having different saturation magnetizations providing a pass band for broad bandwidth operation of said device; said first and second gyromagnetic materials disposed in said device to provide operation in the normal perfect circulation mode with other perfect circulation modes suppressed and wherein for each of said two composite bodies said first and second gyromagnetic materials are concentric first and second ferrite cylinders having first and second diameters, respectively, equal to one-half first and second wavelengths, respectively, of electromagnetic energy transmitted at first and second ferrite frequencies, respectively, where said first and second ferrite frequencies are frequencies within the frequency pass band of said device and where said second ferrite frequency is less than twice said first ferrite frequency.

9. The device of claim 8 wherein said first and second diameters are each determined for "i" equal to 1 and 2, respectively, by:

$$D_{Fi}=C/[(2)(f_{Fi})(\epsilon_{ri})^{\frac{1}{2}}]$$

where:

$D_{Fi}$=diameter of "$i^{th}$" ferrite cylinder

C=velocity of light in space $f_{Fi}$="$i^{th}$" ferrite frequency for "$i^{th}$" ferrite cylinder $\epsilon_{ri}$=relative permittivity of "$i^{th}$" ferrite cylinder.

10. The device of claim 8 wherein for each of said two composite bodies said first and second ferrite cylinders have first and second saturation magnetizations, respectively, where said second saturation magnetization is greater than first saturation magnetization.

11. The device of claim 10 wherein said first and second saturation magnetizations are each determined for "i" equal to 1 and 2, respectively, by:

$$4\pi M_{si}=(f_{Fi})(p)/(2.8\times 10^6)$$

where:

$4\pi M_{si}$=saturation magnetization for "$i^{th}$" ferrite cylinder p=proportionality factor less than unity $f_{Fi}$="$i^{th}$" ferrite frequency for "$i^{th}$" ferrite frequency for "$i^{th}$" ferrite cylinder.

12. The device of claim 8 wherein for each of said two composite bodies said first and second ferrite cylinders are concentrically located within respective dielectric cylinders and wherein the spacing between said first and second ground plane members is defined by:

$$S=(\lambda_h)/[(3)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

13. The device of claim 12 wherein for each of said two composite bodies each of said respective dielectric cylinders has an outer radius which is greater than two or more times the quarter wavlength of the center frequency of the pass band of the device.

14. The device of claim 13 wherein each of composite bodies is juxtaposed said elongated members of the conductive planar means and wherein each of said elongated members includes a plurality of impedance matching steps.

15. The device of claim 14 wherein a plurality of said steps in each of said elongated members correspond respectively to a plurality of different quarter wavelengths less than quarter wavelengths of a plurality of different frequencies, respectively, within the pass band of said device.

16. A 3-port circulator device operative over a broad pass band of frequencies for non-reciprocally transferring microwave energy in TEM mode among three ports, each of said ports having an outer conductor and a coaxial inner conductor, said device comprising, first and second conductive ground plane members disposed in spaced parallel relation to each other and spaced apart by a ground plane spacing S for inhibiting higher-order TEM mode transmission within said pass band, each of said conductive ground plane members connected to the outer conductor of each of said ports, a center conductor disposed in a center plane between and in parallel relation with and equally spaced from said ground plane members, said center conductor having a central portion and three legs extending along radial axes at equal radial angles from said central portion, each one of said legs connected to a different coaxial inner conductor for a different one of said ports for TEM mode transmission within said pass band, each of said legs having a plurality of impedance matching steps extending along one of said axes, first and second composite bodies, said first composite body disposed between said first ground plane member and said center conductor, said second composite body disposed between said second ground plane member and said center conductor, each of said composite bodies including, first and second ferrite cylinders having first and second saturation magnetizations, respectively, where said second saturation magnetization is greater than said first saturation magnetization, said first and second ferrite cylinders disposed concentrically within a dielectric cylinder with said second ferrite cylinder disposed within said first ferrite cylinder, said first and second ferrite cylinders having first and second outer diameters, respectively, of electromagnetic energy transmitted at first and second ferrite frequencies, respectively, where said first and second ferrite frequencies are within the pass band of said device, where said first ferrite frequency is approximately the lowest frequency in said pass band, and where said second ferrite frequency is greater than said first ferrite frequency and is less than twice said first ferrite frequency, said composite bodies functioning to inhibit higher-order TM mode transmission within said pass band and functioning to cause operation in the normal perfect circulation mode while suppressing operation in other perfect circulation modes;

magnetic field means for establishing a magnetic field in a direction normal to said center plane to bias said ferrite cylinders below saturation.

17. The device of claim 16 wherein said first and second saturation magnetizations are each determined for "i" equal to 1 and 2, respectively, by:

$$4\pi M_{si}=(f_{Fi})(p)/(2.8\times 10^6)$$

where:

$4\pi M_{si}$=saturation magnetization for "$i^{th}$" ferrite cylinder

P=proportionality factor less than unity $f_{Fi}$="$i^{th}$" ferrite frequency for "$i^{th}$" ferrite cylinder.

18. The device of claim 16 wherein said first and second diameters are each determined for "i" equal to 1 and 2, respectively, by:

$$D_{Fi}=C/[(2)(f_{Fi})(\epsilon_{ri})^{\frac{1}{2}}]$$

where:

$D_{Fi}$=diameter of "$i^{th}$" ferrite cylinder

C=velocity of light in space $f_{Fi}$="$i^{th}$" ferrite frequency for "$i^{th}$" ferrite cylinder $\epsilon_{ri}$=relative permittivity of "$i^{th}$" ferrite cylinder.

19. The device of claim 16 wherein the ground plane spacing is defined by:

$$S=(\lambda_h)/[(3)(\epsilon_r)^{\frac{1}{2}}]$$

where:

S=ground plane spacing $\lambda_h$=wavelength ($\lambda_h=C/f_h$)

$\epsilon_r$=relative permittivity of dielectric material

C=velocity of light in space $f_h$=highest frequency of pass band.

20. The device of claim 16 wherein said magnetic field means includes one or more permanent magnets.

21. The device of claim 16 where one of said three ports is terminated in the characteristic impedance of said device whereby said circulator is an isolator having a broad bandwidth.

* * * * *